United States Patent [19]

Nielsen

[11] Patent Number: 4,537,320

[45] Date of Patent: Aug. 27, 1985

[54] CENTRIFUGE TUBE HAVING REMOVABLE CROWN AND SWAGE FITTING

[76] Inventor: Steven T. Nielsen, 1126 W. Knickerbocker Dr., Sunnyvale, Calif. 94087

[21] Appl. No.: 546,010

[22] Filed: Oct. 27, 1983

[51] Int. Cl.[3] ..... B65D 39/08

[52] U.S. Cl. ..... 215/276; 220/288; 285/334.5; 285/382.4; 215/31

[58] Field of Search ..... 215/276, 274; 220/288, 220/289, 309, 319; 285/334.5, 382.4

[56] References Cited

U.S. PATENT DOCUMENTS

| | | | |
|---|---|---|---|
| 2,026,168 | 12/1935 | Guarnaschelli | 285/334.5 |
| 2,117,407 | 5/1938 | Davis | 220/289 X |
| 3,265,296 | 8/1966 | Mitchell . | |
| 3,434,615 | 3/1969 | Barletta | 215/276 |
| 3,938,735 | 2/1976 | Wright et al. . | |
| 4,076,170 | 2/1978 | Chulay et al. . | |
| 4,087,043 | 5/1978 | Anderson et al. . | |
| 4,114,803 | 9/1978 | Romanauskas . | |
| 4,358,420 | 11/1982 | Nielsen et al. | 264/538 |

FOREIGN PATENT DOCUMENTS

| | | | |
|---|---|---|---|
| 6607254 | 11/1967 | Netherlands | 215/276 |

*Primary Examiner*—Donald F. Norton
*Attorney, Agent, or Firm*—Alan H. MacPherson; Thomas S. MacDonald; Steven F. Caserza

[57] ABSTRACT

A centrifuge tube for use in an ultracentrifuge has a closed bottom end shaped to mate with the bottom of a rotor cavity, a body portion and an upper end that terminates in a filler stem. The filler stem may be externally threaded. A removable support crown screws on the threaded filler stem or otherwise fits over the filler stem to center and support the stem within the rotor cavity of the ultracentrifuge. A swage plug fits within the support crown to seal off the inner volume of the centrifuge tube during centrifugation. The tube is filled and access is obtained to the liquid sample by removing the swage plug; sealing is accomplished by reversing the process. In one embodiment a universal crown, of a diameter smaller than the expected diameter of the rotor, is used in conjunction with a support bushing of suitable annular thickness to firmly support the filler stem in the rotor cavity. In other embodiments the swage plug has central openings which permit the removal of sample fractions or the pumping of fluid into and removal from the centrifuge tube.

15 Claims, 14 Drawing Figures

CENTRIFUGE TUBE HAVING REMOVABLE CROWN AND SWAGE FITTING

BACKGROUND OF THE INVENTION

1. Field of the Invention

The present invention is directed to centrifuge tubes and associated sealing means for use with ultracentrifuge apparatus, and more particularly, relates to a thin wall, flexible centrifuge tube and associated sealing mechanism.

2. Description of the Prior Art

The need to place a liquid sample into a centrifuge rotor and subsequently remove it after centrifugal separation has caused the development of a wide variety of centrifuge containers with particular features suiting specific work. The purpose of a removable container, whether rigid, flexible, translucent or transparent has been to permit the operator to externally prepare a sample, load it into a rotor, perform centrifugation, remove the container with care to prevent remixing, and then to examine or analyze the separated sample.

With respect to ultracentrifugation where rotational speeds exceed 25,000 rpm, four primary categories of containers have gained acceptance and are in widespread use: rigid thick wall open-ended cylindrical tubes with hemispherical bottoms, flexible thin wall open-ended cylindrical tubes with hemispherical bottoms, rigid thick wall cylindrical bottles with flat or hemispherical bottoms, and flexible integral cylindrical tubes with essentially hemispherical tops and bottoms which are sealed by heat treatment rather than by mechanical cap or closure means applied in connection with the centrifuge process.

Rigid thick wall open-ended cylindrical tubes were developed primarily for fixed angle rotors where the angle of the tube with respect to the spin axis is less than 90 degrees; typically, the angle is 10 to 45 degrees. The rigid tube walls allow for a fill level low enough to prevent fluid spilling out during centrifugation since the walls are strong enough to withstand the centrifugal forces without containing a force-absorbing liquid. These tubes are generally reuseable because of their minimum residual distortion during centrifugation. The tube is unloaded from the open upper end and the walls or bottom need not be punctured or sliced as with flexible tubes to facilitate sample removal. In some cases, caps are used to increase the available volume of the tube by preventing spillage during centrifugation even with the increased fill volume. These tubes are generally costly and cannot be punctured by a needle for sample removal, and if hazardous biological samples require a single use and then discard of the tube, the cost is usually prohibitive. These tubes are used primarily for the convenience of quick loading of the liquid sample but at the disadvantage of a loss of available internal volume.

Flexible thin wall cylindrical tubes with open ends are used in swinging bucket rotors without caps. The angle of the tube with respect to the spin axis is 90 degrees and therefore no caps are required since the centrifugal forces acting on the fluid are directed towards and hold the fluid in the bottom of the tube. Because the tube is open at one end and the liquid meniscus is very near the top of the tube, tubes of larger diameter are subject to spillage by sloshing and wave action of the meniscus as the rotor with the tube in a bucket is placed in the centrifuge. Such spillage can actually facilitate tube collapse during centrifugation by loss of available side wall support or can contaminate the rotor if radioactive samples are used. Flexible thin wall tubes when used in fixed angle rotors require cap assemblies to contain the liquid under high hydrostatic pressure and to prevent collapse of the tube. Typically, the cap assemblies consist of relatively complex metal components and the primary seal is formed with the tube by an elastomer ring or bushing. In L. C. Marks, "Centrifuge Test Tube Cap", U.S. Pat. No. 3,459,369 a typical capping mechanism of this type is shown. As higher speed rotors have been developed, improvements in capping means have been required. Open-end tubes achieve their seal at the maximum diameter of the tube, and with lager diameter tubes, the cold flow potential of elastomeric seals increases, thereby making sealing more difficult. In H. E. Wright, et.al., "Capping Assembly for Thin Wall Centrifuge Tubes", U.S. Pat. No. 3,938,735, the elastomeric sealing ring at the large diameter of the tube is eliminated and a compression of the tube outer wall is utilized for sealing. High torques are required to compress the relatively large annular ring at the seal point and a low friction bushing is incorporated on the top of the crown to keep the crown from twisting with respect to the stem during the procedure to tighten the assembly. In the two patents of marks '369 and Wright '735 special bench-mounted vises and calibrated torque wrenches are required to achieve a reliable seal. Both also require an additional fill hole for either the entire sample addition or for "topping up" the tube after insertion of the main crown and stem. It is essential that the maximum volume of liquid be added so that collapse of the tube into empty regions is minimized during centrifugation. Also, the opaque metal components make it difficult to determine the exact fill level and the size of residual, trapped bubbles. For this reason, viewing holes are added to the side of the stem skirts, a feature which potentially weakens the thin skirt. Due to the inability to see trapped bubbles, complete filling of the tube is extremely difficult to achieve. The threaded fill hole must also be sealed, which is accomplished by the insertion of a small set screw which in turn compresses a small plastic bushing swaged in the bottom of the fill hole. After repeated use, the plastic bushing may extrude through the hole and settle in the previously filled tube. Another bushing must then be inserted, swaged with a special tool, and the set screw torqued into place. As a result, density gradient layers, carefully formed in the liquid contents of the tube, may be disturbed with the extended handling and torquing procedures. The approach described in L. Gropper, et al., "Centrifuge Test Tube Stopper", U.S. Pat. No. 3,720,502 has had no practical application.

Another application of flexible, thin wall cylindrical tubes with open ends is with vertical rotors where the angle of the tube with respect to the spin axis is zero. This application requires special consideration for the sealing of open-ended tubes because the maximum hydrostatic pressure coincides with the maximum diameter of the tube at the maximum spin radus, and the minimum pressure coincides with the diameter of the tube at the minimum spin radius. The pressure and gravitational force gradients across the tube diameter causes severe cold flow of the seal material and uneven distribution of initial cap torquing forces. In V. C. Rohde, "Method of Gradient Separation", U.S. Pat. No. 4,015,775 a zonal gradient separation method which makes use of this phenomenon is described although no tube or sealing form is disclosed. In S. J. Chulay, "Tube Cap Assembly for Preparative Centrifuge Rotors", U.S. Pat. No. 4,076,170 a complex metal and elastomeric sealing assembly for centrifuge tubes is described. In R. B. Anderson, "Dual Seal Arrangement for a Centrifuge Rotor Tube Cavity", U.S. Pat. No. 4,087,043 a metal and elastomeric seal assembly is described which also incorporates the technique of compressing the outer diameter of the tube wall inwardly as described above for Wright '735. Both require that the top hole be filled with a set screw and seal bushing so that they both possess the limitations described previously. In W. A. Romanauskas, "Centrifuge Tube Encloser", U.S. Pat. No. 4,114,803 the use of a large diameter swage plug in combination with a plastic liner to achieve a seal against the tube wall is described; the tube in turn is compressed directly against a seat at the top of the rotor cavity itself. Another embodiment provides a back-up ring in place of direct compression against the rotor seat. Problems with reliability of this seal led to the improvement of D. A. Webster, "Centrifuge Tube Encloser", U.S. Pat. No. 4,166,573 which provided grooves in the swage plug and claimed improved reliability. In D. A. Webster, et. al., "Centrifuge Tube Seal", U.S. Pat. No. 4,222,513 this general approach was further developed by adding an elastomer seal to maintain an axial force to thereby compensate for cold flow of the sealing components.

Rigid thick wall cylindrical bottles with threaded necks are primarily used for convenience. The bottles are sealed by the use of plugs fitted with elastomeric rings which seal against the internal or upper surface of the rigid neck. Threads on the outside diameter of the neck are present to provide means of applying compression to the elastomeric seals by means of a locking cap. Bottles like rigid open-ended tubes are costly, reuseable, unpunctureable and unslicable and sacrifice convenience for internal volume and easy sample removal. In N. Cho, "Centrifuge Sample Holder", U.S. Pat. No. 3,366,320 an older type of centrifuge bottle is described where no elastomeric seals are used and where a seal relies on a integral v-shaped ring to press against the top of the bottle neck. This sealing method cannot be used with the higher speed ultracentrifuge rotors (more than 25,000 rpm) because the cap and neck distort under the extreme forces and allow leakage. In W. J. Piemonte, et.al., "Bottle Support and Cap Assembly for Centrifuge", U.S. Pat. No. 3,071,316 a bottle sealing cap and support is described which minimizes distortion of the neck. The bottle extends beyond the rotor cavity to maximize the size of the bottle and an extending bottle neck support is required to maintain the neck geometry and therefore the seal. Although the bottles are described as distortable, they are in fact rigid in comparison with a thin wall, flexible centrifuge tube. In D. F. Mitchell, "Plastic Centrifuge Bottles and Caps Therefor", U.S. Pat. No. 3,265,296, and in A. J. Barletta, "Centrifuge Bottle and Closure Therefor", U.S. Pat. No. 3,434,615 rigid bottles sealed with elastomeric seals and screw caps are described.

Flexible, integral one-piece centrifuge tubes are used in both fixed angle and vertical rotors. Although caps as such are not required, support spacers with precise features are required to provide support to the upper end of the tube and to prevent collapse. The spacers are usually single piece plastic or metal shapes and do not contact the fluid directly. Although the integral tube and associated spacer appear less complex, the complexity has merely been shifted from a mechanical assembly within the rotor to an electro-mechanical apparatus on the laboratory bench. The sealing apparatus contains resistance heaters, timers, force applying arms, etc., and requires that holding blocks precisely made for each tube size, be exactly positioned under the heating unit; seal formers are required in addition to the heating and cooling apparatus to melt and mold the seal at the top of the tube. The integral single-piece tube also has the disadvantage that it can only be used once since the seal is formed from an integral stem which is generally cut off in the procedure of removing the sample after centrifugation. Because the integral stem is melted and formed to provide the seal, the diameter of the initial fill hole is kept small in an attempt to control the amount of molten plastic. The small fill hole unfortunately restricts access to the tube. Tube filling is therefore commonly accomplished with hyperdermic needles which must be inserted through the stem hole. The resultant fluid passage into the stem is very small and can cause the shearing of long, fragile molecular chains of biological compounds such as DNA. Unloading may be equally difficult. And, problems in heat sealing may occur when residual drops of fluid remain in the stem region. In addition, the subsequent melting of the plastic may vaporize the residual fluid producing sufficient local vapor pressure to cause the stem to reopen before solidification of the molten stem material. Since the only available plastic material is in the integral stem, additional attempts to reseal the tube often are not successful, and the tube must be discarded after inconvenient retrieval of the uncentrifuged sample. Although there are no metals present as in the other cap assemblies described above, the effects of heat may be detrimental to a sensitive biological sample. Integrable single piece tubes are described in the following patents: S. T. Nielsen, "Integral One Piece Centrifuge Tube", U.S. Pat. No. 4,301,963; S. J. Chulay, et.al., "Supporting Cap for Sealed Centrifuge Tube", U.S. Pat. No. 4,304,356 describing a spacer and integral tube with a bell-shaped top rather than the essentially hemispherical top to give greater rigidity to the spacer; S. J. Chulay, et.al., "Modular Supporting Cap and Spacer for Centrifuge Tubes", U.S. Pat. No. 4,290,550, describing a modular spacer to be used in conjunction with a bell-shaped tube top in both vertical and fixed angle rotors; and in K. Ishimaru, "Centrifuge Apparatus for Reorienting Gradients", U.S. Pat. No. 4,360,150 describing an integral one-piece tube with a spherical geometry to facilitate gradient reorientation.

In centrifuge tubes it is desirable that liquid samples be capable of being added to the tube before a cap or crown is in place so that it can be filled to an optimum volume and so that air bubbles can be examined and removed. It is also desirable to be able to readily obtain access to the liquid sample in the centrifuge tube before and after centrifugation. Preferable, after access is obtained the centrifuge tube can easily be resealed and reused. And it is desirable that a centrifuge tube be provided which can fit into ultracentrifuge rotors of different inner diameters. Also, a centrifuge tube is most useful when it can be used with vertical, angled rotors. All of the above objects are addressed by the centrifuge tube with removable crown and swage fitting of the present invention.

BRIEF DESCRIPTION OF THE DRAWINGS

For a more complete understanding of the centrifuge tube and associated sealing mechanism of the present invention reference may be had to the accompanying drawings which are incorporated herein by reference and in which.

SUMMARY

A centrifuge tube is provided for use in an ultra centrifuge. The centrifuge tube is closed on the bottom and has a bottom shaped to mate with the shape of the bottom surface of a rotor cavity. The body is cylindrical to thereby fit within a rotor cavity. The top terminates in a filler stem which may be externally threaded. A removable support crown screws on or otherwise fits over the filler stem and centers the stem within the rotor cavity. A swage plug fits within the support crown to seal off the inner volume of the centrifuge tube during centrifugation. Filling of the liquid sample and access thereto is obtained by removing the swage plug; sealing is accomplished by reversing the process. In one embodiment a universal crown, of a diameter smaller than the expected cavity diameter, is used in conjunction with a support bushing of suitable annular thickness to firmly support the filler stem in the rotor cavity. In another embodiment of swage plug having a threaded bottom extension is employed to form a press fit between the filler stem and the inner surface of the crown. In yet another embodiment, the swage plug is provided with means for removing sample fractions from the centrifuge tube. In another embodiment an O-ring is provided as part of the swage plug to effect an efficient seal and in still another embodiment annular protrusions are provided on the sealing surface of the swage plug to complete the seal.

DETAILED DESCRIPTION

In providing centrifuge tubes for use in the rotors of ultracentrifuge chambers it is important to offer multiple sample utilization, ease of use, a maximum fill of the tube, means of eliminating air bubbles, access to sample before and after centrifugation, universality (use in all sizes of rotors) and noncontamination. Preferably, plastic parts will be used to avoid metal ion contamination. While there have been abundant developments in centrifuge tube design, as indicated in the references described in the Background of Invention, there has not previously been supplied a unit having all these desired features. The centrifuge tube with removable support crown and swage plug of the present invention provides these features by using a cylindrical tube having a filler stem, a removal support crown which fits over this stem and a swage plug which fits into the center of the removable support crown thereby swaging the stem outwards toward the crown. Access is possible through the crown at anytime by removable of the swage plug. In one embodiment the swage plug is fitted with a means to obtain a sample fraction with the swage pluge in place. There is no need to cut or puncture the tube to fill or remove the sample. In another embodiment a universal crown, of narrower diameter than most rotor cavities, is provided for placement over the filler stem and a support bushing of suitable size centers and holds the crown and tube in the rotor cavity.

Figure 1:
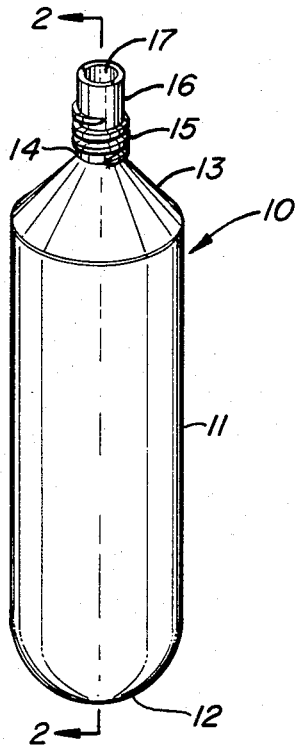
FIG. 1 is a perspective view of one embodiment of the centrifuge tube of the present invention.
Figure 2:
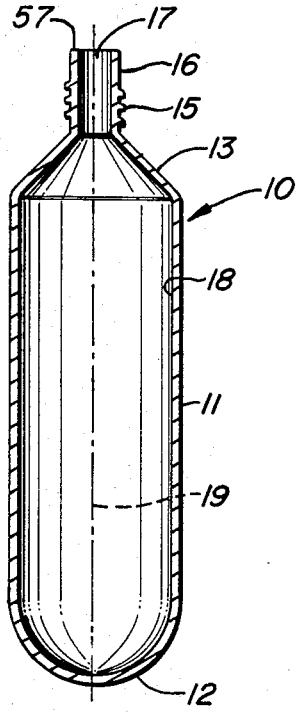
FIG. 2 is a cross-sectional view of the centrifuge tube of FIG. 1.

The preferred embodiment of the centrifuge tube 10 of the present invention is shown in FIG. 1. A cylindrical central portion 11 is closed on the bottom by a hemispherical bottom portion 12, and terminates on the upper end with a conical top portion 13. Upper conical portion 13 has a reduced diameter neck 14 connected to a protruding cylindrical stem 16. The protruding cylindrical stem 16 has an external thread 15 and a fill hole 17. A sectional view of the preferred cylindrical tube 10 is shown in FIG. 2 where it can be seen that a liquid sample can be loaded into the tube through the relatively large fill hole 17 and then will be contained by the internal surface 18 of the cylindrical control portion 11, hemispherical bottom portion 12 and conical top portion 13.

Figure 3:
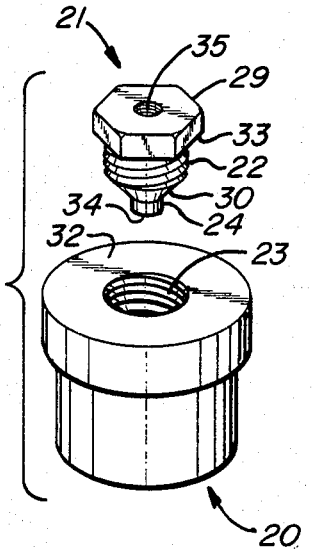
FIG. 3 is an expanded perspective view of a seal assembly showing a support crown and swage plug.

In the exploded view of FIG. 3, the closure means is shown to consist of the support crown 20 and the swaging plug 21. The support crown 20 receives the swaging plug 21 by the rotational engagement of the external threads 22 of the swage plug with the internal threads 23 of the support crown. The pilot diameter 24 of the swage plug 22 will engage the fill hole 17 of the tube in FIG. 2 after the support crown is rotated onto the external threads 15 of centrifuge tube 10 and turned to finally rest on the conical top portion 13.

Figure 4:
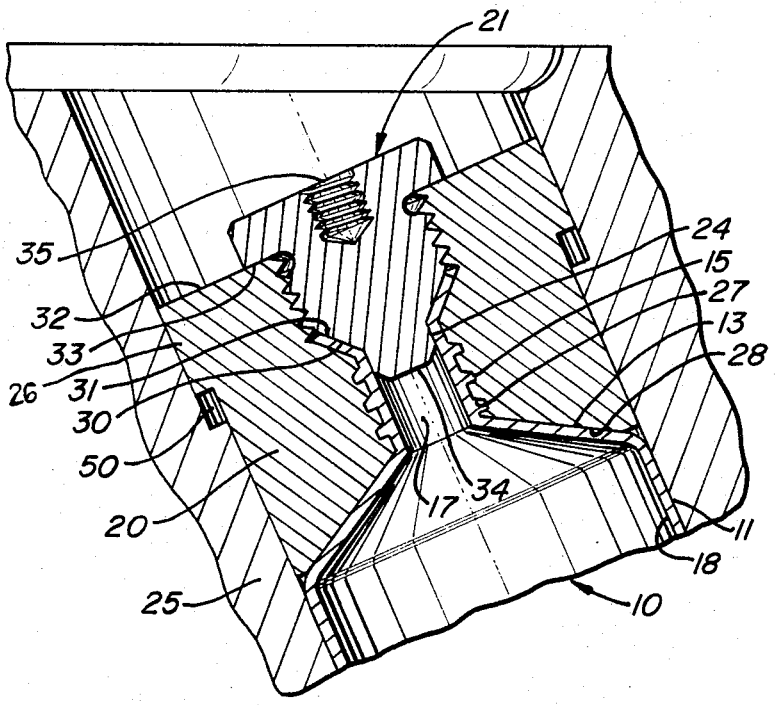
FIG. 4 is an enlarged partial cross-sectional view of a centrifuge tube, in place in a fixed angle rotor and having a seal formed by a support crown and swage plug.

The centrifuge tube 10 which is used in conjunction with the support crown 20 and swaging plug 21 is shown in the sectional view of FIG. 4 assembled and placed in a cavity or bucket in centrifuge rotor 25, the top portion of the support crown residing in the rotor counterbore 26. The support crown 20 will usually be threaded onto the external tube neck threads 15 prior to insertion into a centrifuge rotor. A fluid sample can be added to the tube either before or after assembly of the support crown and tube. The tube neck threads engage the internal support crown threads 27 and hold the two together while keeping the conical internal surface 28 of the support crown against the upper conical external surface 13 of the tube. This offers the advantage of handling the assembly after filling the tube with liquid by handling the support crown so that no pressure is transmitted to the tube side walls 11 that could cause liquid to spill out of the yet unsealed fill hole 17. Once the support crown is firmly attached to the tube neck, the neck is held in a fixed position with respect to the body of the tube while the swage plug is exerting a combined force which is axially downward and radially outward. Without the threaded engagement of the support crown, the tube neck would be forced only in a downward rather than in a radially outward direction.

The swage plug is inserted into the top internal threads 23 of the support crown and turned down by means such as a hand-held socket wrench which engages a hexagonally shaped feature 29 and transmits torque until the pilot diameter 24 of the swage plug engages the inner surface of the tube fill hole 17. As rotational engagement of the threads continues, the top surface 57 of the stem 17 of the centrifuge tube contacts a tapered surface 30 of the swage plug causing the stem to swage in a radial or outward direction until it contacts a similarly tapered seat 31 in the support crown, shown in FIG. 4, and tightly compresses the tube material between the matched, tapered seats. An extremely secure and leak-proof seal occurs as the tube is made of a flexible thermoplastic material such as polyallomer or polypropylene copolymers and will cold flow and distribute material over the tapered seat surfaces. Although polyallomer has been mentioned as a suitable material, other flexible plastic materials would also be suitable. The tapered seat surfaces may be smooth but could contain ridges or grooves to facilitate sealing. The swage plug 21 will finally come to rest against the top surface 32 of the support crown or there may be a slight gap between the top surface 32 of the support crown and the bottom surface 33 of the hexagonal portion 29 of the swage plug. There also may be a gap 50 between the support crown 20 and the bottom of the rotor counterbore 26 to facilitate assembly and to compensate for any size variations in assembly or manufacture of the components. The tapered seats of the swage plug and support crown may match perfectly or be slightly different since the flexible thermoplastic material may be pressed together, but both should be in the range of 30 to 60 degrees from the vertical. Forty-five degrees has been found to be a preferred angle, as it is easy to manufacture and transmits adequate compression force for sealing.

An important feature of this invention is that the liquid sample can be added to the tube prior to the support crown being connected to the tube and a precise determination made of the fill level. The presence of entrapped air bubbles can also be detected by viewing through the transparent or translucent walls of the neck region. If desired, the tube can be manipulated until the trapped air is removed. The removal of trapped air and the precise positioning of the liquid meniscus to the point of maximum tube volume decreases the amount of tube distortion during centrifugation since the full volume of liquid provides resistance to the deformation of the tube. Thus the liquid meniscus can be easily judged to be in the reduced diameter neck just below the tip 34 of the swage plug 21.

Another important feature of the centrifuge tube of the present invention is that if for some reason it is determined that the sample must be accessed, the swage plug 21 can be unscrewed from the support crown and later replaced with complete reestablishment of a liquid tight seal capable of withstanding the forces of centrifugation. The support crown is removed from a previously sealed tube by the rotational disengagement of threads 15 from cylindrical stem 16. Although the tube neck remains partially swaged it can be easily extracted down through the support crown because of the presence of internal threads on the support crown.

Another important feature of this centrifuge tube is that the tube is reusable, providing of course it has not been previously punctured or sliced for sample removal. Even though a previously sealed tube retains a swaged top, the presence of internal threads on the support crown assists in drawing the crown over the swage until the swaged portion rests in the sealing seat of the support crown where it can be resealed with the swage plug.

Figure 5:
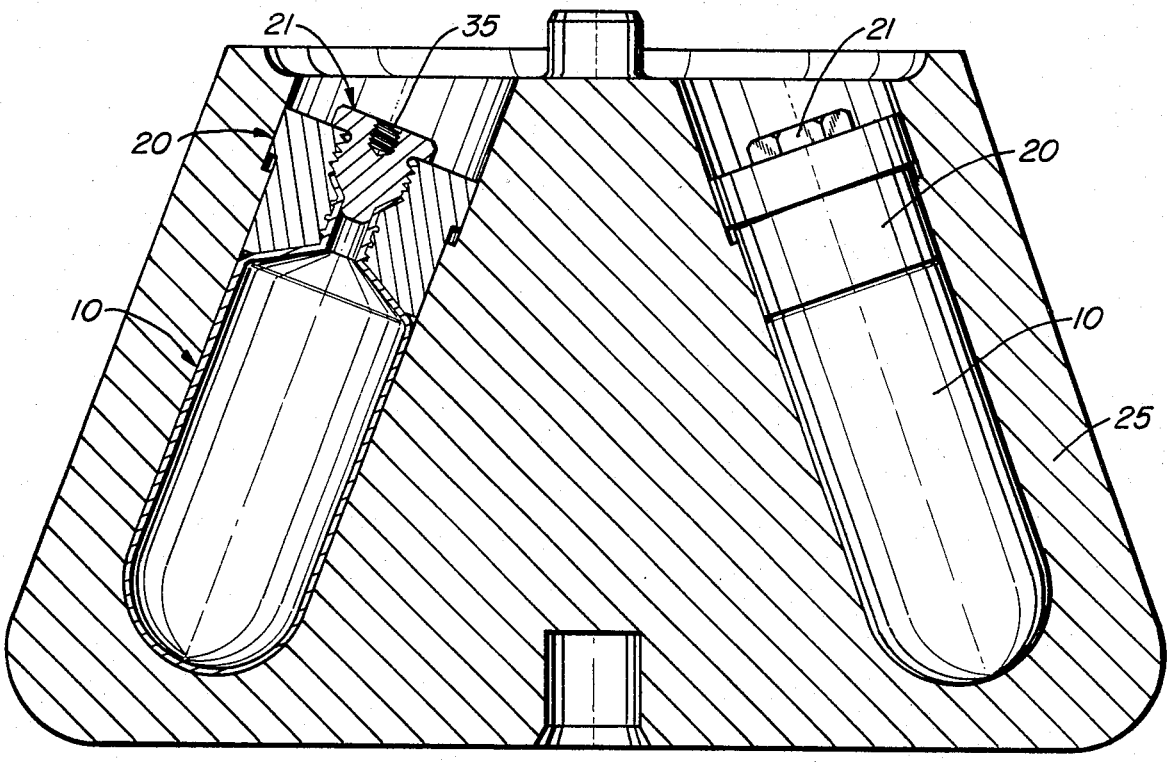
FIG. 5 is a cross-sectional view of a sealed centrifuge tube and seal assembly positioned in a fixed angle rotor.
Figure 6:
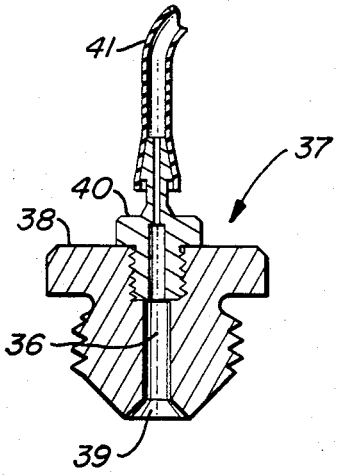
FIG. 6 is a swage plug assembly including means for removal of sample from a centrifuge tube after centrifugation.

FIG. 5 shows a typical fixed angle centrifuge rotor 25 such as those described in Beckman catalog, PL-174JJ, "Rotors, Tubes and Accessories". The centrifuge tube removable crown and swage plug assembly rests within an internal cavity. After centrifugation, the assembly is removed by inserting a suitable threaded tool into the tapped hold 35, shown in FIG. 1, of the swage plug 21 and extracting the assembly. The support crown 20 is held while the swage plug 21 is unscrewed. At this point the liquid sample can be removed by a variety of conventional means such as pouring, squeezing, inserting needles or pipettes through the top, etc., or by another feature of this invention which is shown in FIG. 6. In FIG. 6 a swage plug assembly 37 for fraction recovery is provided with a fluid passage extending between the upper surface 38 and bottom surface 39. The plug assembly 37 can be inserted and turned downward against the previously swaged tube. A threaded and barbed plastic tubing fitting 40 can be turned into the top of the seal plug 37 so that one end of a length of plastic tubing 41 can be connected to the barbed extension of fitting 40. The tube can be punctured through the bottom hemisphere 12 by a needle and additional neutral fluid can be pumped into the tube causing the centrifugally separated sample to be displaced through the top of the tube and out the center of plastic tubing fitting 40 in swage seal plug 37. A pressure tight seal is maintained by the swaged seal plug 37 throughout the sample removal procedure.

Figure 10:
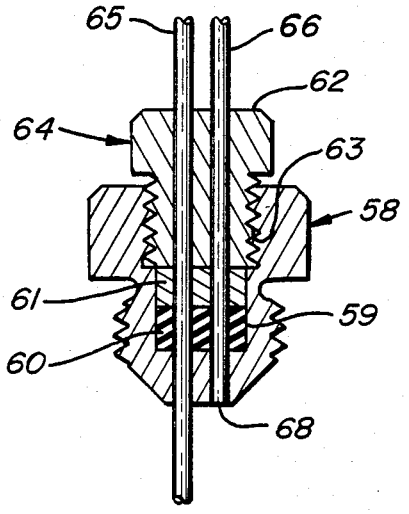
FIG. 10 is a cross-sectional view of a swage plug assembly including means for removal of sample fractions from a centrifuge tube after centrifugation.
Figure 11:
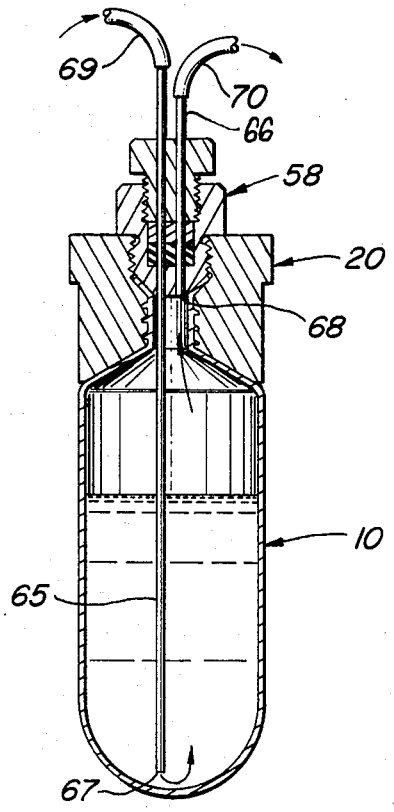
FIG. 11 is a cross-sectional view of a tube, support crown, and swage plug assembly with tubing inserted into the centrifuge tube for removal of sample fractions.

Another type of swage plug assembly for same fraction recovery is shown in FIG. 10. The swage plug 58 contains a cylindrical bore 59 into which is inserted as elastomer gasket 60, a compression washer 61 and a compression bushing 62. The compression bushing 62 contains an external thread 63 which mates with an internal thread of the swage plug 58 and when rotated by its hexagonal top 64 exerts a compression force on the washer 61 and elastomer gasket 60. Two thin wall tubes preferably constructed of corrosion resistant stainless steel are held in place in the swage plug assembly by compression forces transmitted by the elastomer gasket 60. One thin wall tube 65 passes through the swage plug assembly and is usually positioned with its bottom or exit end 67 near the bottom of the centrifuge tube as shown in FIG. 11. Another thin wall tube 66 is positioned with its bottom or entry end 68 flush with the bottom of the swage plug 58. FIG. 11 shows the swage plug 58 seated in the support crown 20 where it seals the centrifuge tube 10 by a swage seal. Positioning of the bottom end 67 of the thin wall tube 65 at the bottom of the centrifuge tube 10 and pumping of fluid through a flexible connection tubing 69 causes sample liquid to be displaced upward to the bottom or entry end 68 of a thin wall tube where it passes out of the swage plug assembly through another flexible connection tube 70 into some type of collection receptable.

The removable crown and swage plug are preferably constructed of plastic materials rather than metals thus eliminating the possibility of metallic ions coming into contact with sensitive biological materials. Since the crown contacts the precisely mechined bore of the rotor cavity it is most preferrably constructed of a plastic material to prevent scratching or damage to the rotor cavity. Also, the use of a plastic sealing assembly of lesser density and weight than that of an equivalent metal assembly imparts lower stresses to the rotor during centrifugation.

Figure 7:
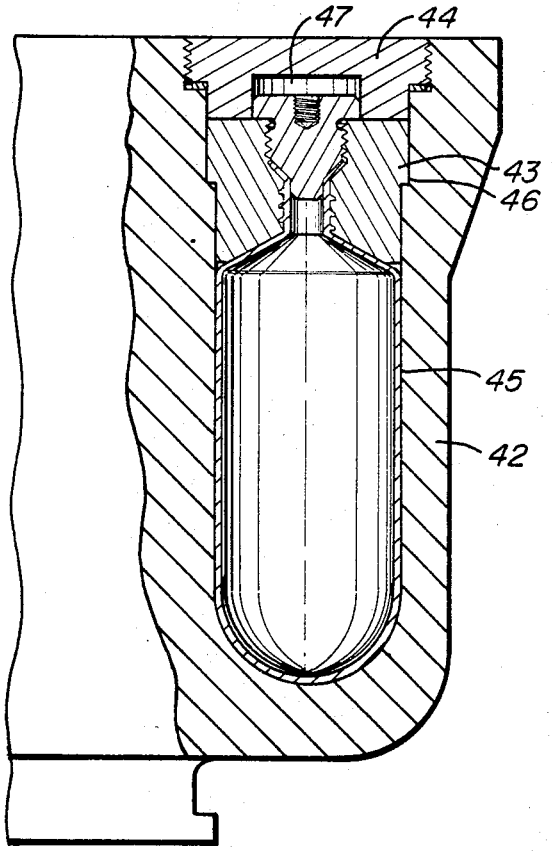
FIG. 7 is a partial cross-sectional view of a tube, support crown and swage plug positioned in a vertical tube rotor.

In FIG. 7, a tube and sealing assembly in accordance with the present invention is shown positioned in a rotor 42. In this circumstance, the removable support crown 43 will be proportioned such that no clearance or space exists in the rotor bore 45 or counterbore regions 46 when the secondary rotor plug 44 is torqued into place unless it is desired to allow for variations in tolerance. A gap 47 may exist for clearance with the swage plug assembly but no allowance is made for the relative movement of the centrifuge tube and crown with respect to the rotor.

Figure 8:
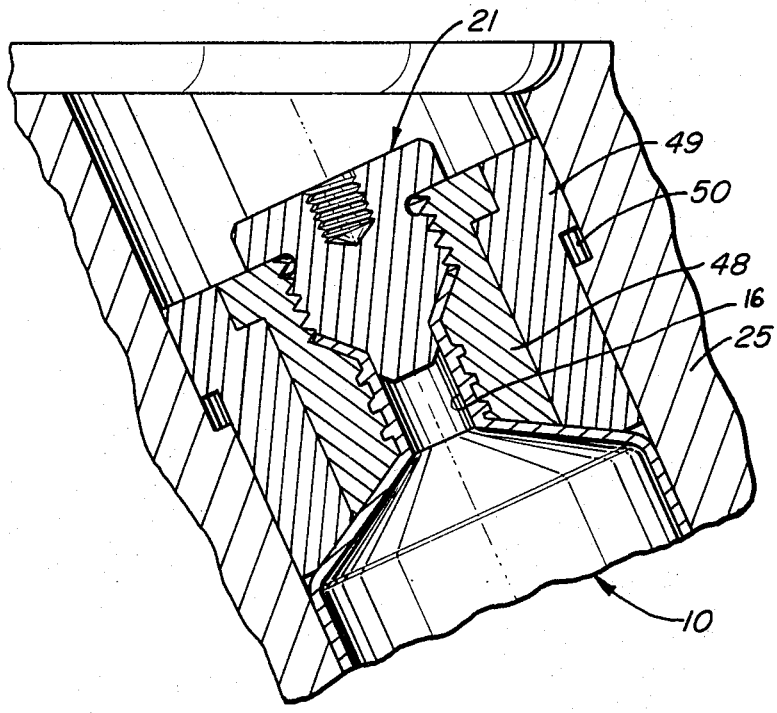
FIG. 8 is a cross-sectional view of an alternate embodiment of the present invention shown incorporating a universal support spacer.

An alternate embodiment of the present invention is shown in FIG. 8 where the support crown is formed of two subcomponents consisting of a universal support crown 48 and a support bushing 49. The universal support crown 48 fits over the cylindrical stem 16 and the support bushing 49 fills the space between the outside of the support crown 48 and the inside of the rotor cavity. The tube and swage plug 21 are the same as in previous embodiments. The universal support crown can be of a size which exactly fits the smallest rotor counterbore in a series of rotor sizes, and an additional support bushing 49 used to adapt the universal support bushing to larger rotor counterbores.

Figure 9:
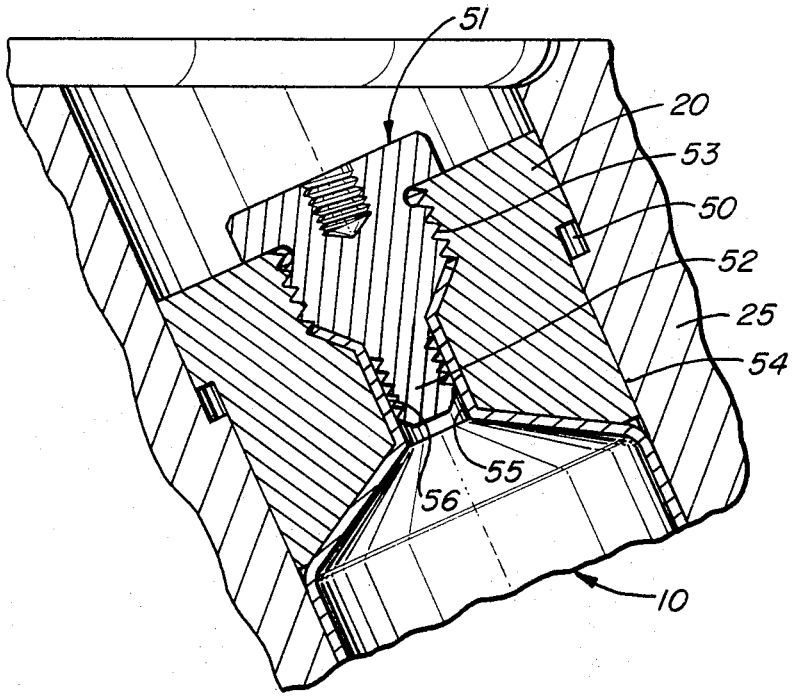
FIG. 9 is a cross-sectional view of still another embodiment of the present invention.

A further embodiment of the present invention is shown in FIG. 9. In this embodiment the swage plug 51 has an extended bottom feature 52 threaded to the same thread pitch as the engaging threads 53 at the larger diameter of the swage plug. The support crown 54 in this case has no internal threads and the centrifuge tube 55 also has no external threads on the stem. As the swage plug 51 is rotated downwardly, the extended threaded feature 52 engages the inside diameter of the tube stem in an interference fit thereby causing the stem to remain fixed with respect to the support crown 54 while the swage seal is made. All the while the removable crown 54 is held securely in place within the cavity in rotor body 25. The equal thread pitch on both the extended feature 52 and engaging threads 53 produces the result that a single revolution causes a corresponding advancement of the body of swage plug 51 and of the extended feature 52, and the stem of the centrifuge tube remains in position but is unable to move downward during the swaging operation.

Figure 12:
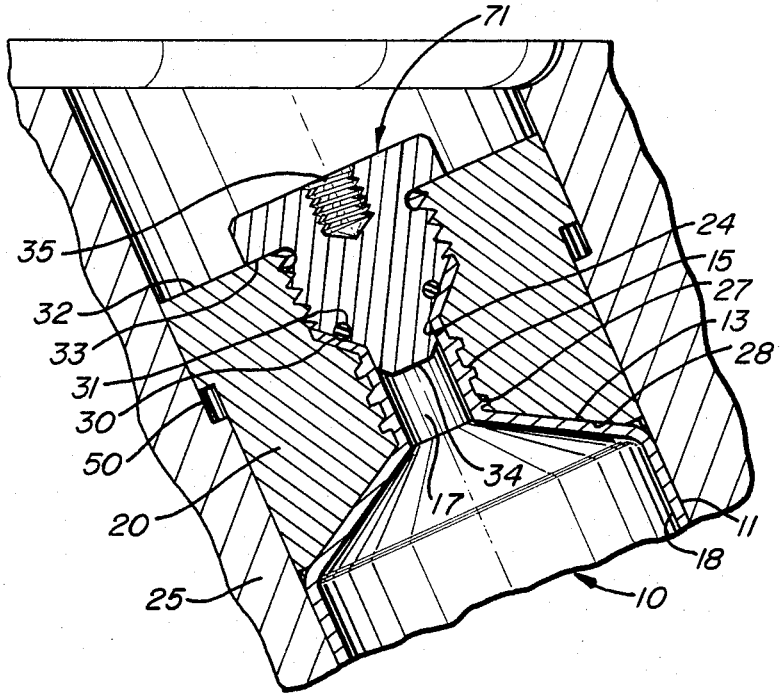
FIG. 12 is a cross-sectional view of a tube, support crown, and swage plug assembly showing an elastomeric O-ring fitted in the swage plug to facilitate the seal between the swage plug and support crown.

Another embodiment of the present invention is shown in FIG. 12. In this embodiment the swage plug 71 has a groove 31 on the conical swage surface in which an elastomer O-ring 30 rests. The O-ring 30 adds the feature of a secondary seal to the primary swage seal accomplished in the swage region adjacent to the ring. Future rotor developments with increased speeds may require additional seal security. The use of an O-ring seal integral to the swage seal offers a compact method of accomplishing two seals in the space of one. In this case, as the swage plug is screwed down into the crown, the stem of the tube is swaged in the typical manner described previously, but as the swaging continues up the plug seat surface, the tube end passes over the O-ring and on to its final position at the top of the conical swage surface. A secondary seal is provided since the primary swage seal exists prior to the O-ring and another swage seal exists after the O-ring. Such a secondary seal can also be provided by forming the surface of the conically shaped bottom tip of the swage plug 71 with ridges or protrusions above the surface which first contact the inner surface of the filler stem.

Figure 13A:
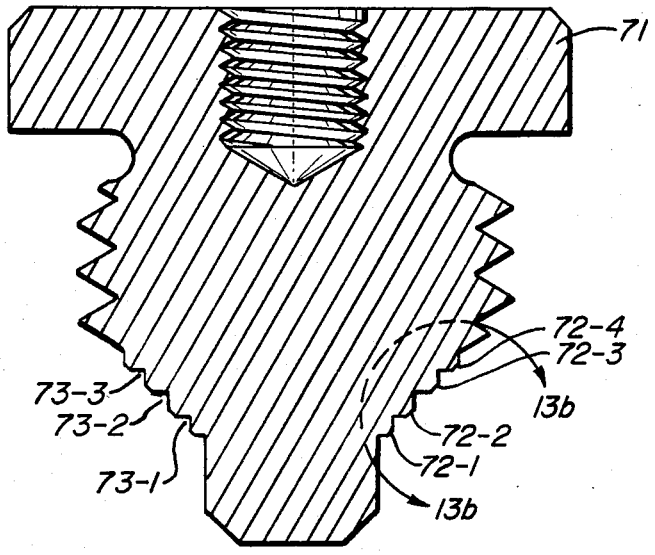
FIGS. 13*a* and 13*b* illustrate in cross-section a swage plug with at least two annular protrusions on the sealing surface.
Figure 13B:
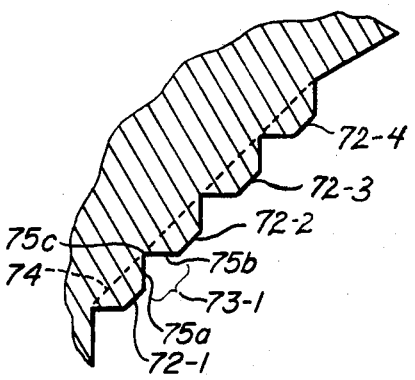

A further embodiment of the present invention is shown in FIGS. 13*a* and 13*b* where another version of seal plug or swage plug 71 is shown. In this embodiment the swage plug 71 has multiple ridges or rings 72–1 through 72–4 protruding from the otherwise smooth swage seal surface 74 (shown as a dashed line in FIG. 13*b*). Bounded by any two adjacent ridges is a recess such as recess 73–1 having two intersecting surfaces 75*a*, 75*b*, the intersection 75*c* of whichis conicident with the plane of the original swage surface 74. The shape of the ridges 72 and grooves 73 is not particularly important, but one convenient shape is a truncated triangular ridge and corresponding recess. The shapes of the ridges and recesses are not of primary importance; it is the fact that any two ridges, regardless of shape, serve to bind and contain the swaged centrifuge tube stem material during centrifugation. Four protruding ridges 72–1 through 72–4 with three corresponding recesses 73–1 through 73–3 are shown in FIGS. 13*a* and 13*b*.

A review of the progression from an integral secondary seal by elastomeric ring to multiple ridges may be helpful. One protruding ridge serves to emulate the protrusion of an elastomeric ring. Two protruding ridges serve to contain a recess which could limit cold flow of swaged centrifuge tube stem material during centrifugation. Multiple ridges and recesses simply repeat the feature of two ridges, recess encompassed thereby, and promote a more efficient seal within a limited area of swage surface 74.

While several embodiments of this invention have been disclosed, the above description is meant to be illustrative only and not limiting.

I claim:

1. A centrifuge tube for repeated and reliable use in an ultracentrifuge, comprising:

a tube having an enclosed bottom portion, a body portion and a partially enclosed upper end, said upper end terminating in a filler stem;

a support crown for fitting over said filler stem when said tube is placed in a rotor cavity within said ultracentrifuge; and a swage plug for insertion into said support crown to cause a swaged seal to be formed between said filler stem and the internal surface of said support crown.

2. A centrifuge tube in accordance with claim 1 in combination with a support bushing to be fitted over said support crown to permit said centrifuge tube to be used in rotor cavities of varying diameters.

3. A centrifuge tube in accordance with claim 1 wherein said filler stem has external threads and said support crown has internal threads, said external threads of said filler stem and said internal threads of said support crown having the same pitch to permit said support crown to be screwed onto said filler stem.

4. A centrifuge tube in accordance with claim 1 wherein said body portion of said centrifuge tube possesses a cylindrical shape and said partially enclosed upper end of said cylindrical tube possesses an outward conical taper which terminates in said filler stem.

5. A centrifuge tube in accordance with claim 1 wherein said swage plug has a centrally disposed inset region to permit insertion, removal or rotation by a tool.

6. A centrifuge tube in accordance with claim 1 wherein said swage plug is formed with a hollow spindle in its upper end for attachment of tubing to permit removal of selected liquid fractions from said tube without having to remove said support crown or said swage plug.

7. A centrifuge tube in accordance with claim 1 wherein said swage plug has a protruding, cylindrically shaped lower pilot extension such that when said swage plug is screwed into the inner surface of said support crown said pilot extension engages said filler stem.

8. A centrifuge tube in accordance with claim 1 wherein said support crown has an open central region having internal threads to receive said swage plug and said swage plug has exterior threads, said internal threads of said support crown and said external threads of said swage plug having the same pitch to permit said swage plug to be screwed into said support crown.

9. A centrifuge tube in accordance with claim 8 wherein said swage plug has an inverted conically shaped lower tip and said support crown has a conical inner surface shaped to mate with said conically shaped lower tip of said swage plug whereby the upper end of said filler stem is swaged between said conical surfaces when said support crown is in place and said swage plug is screwed into said support crown.

10. A centrifuge tube in accordance with claim 1 wherein said swage plug has a cylindrical bore in combination with a gasket seated within said bore and a bushing for compressing said gasket against said seat, said gasket having openings for at least one sample removal tube.

11. A centrifuge tube in accordance with claim 10 wherein said gasket has openings for two sample removal tubes, in combination with two tubes to allow fluid to be pumped into said tube and removed from said tube.

12. A centrifuge tube in accordance with claim 10 in combination with a washer positioned between said gasket and said bushing.

13. A centrifuge tube in accordance with claim 1 wherein the bottom portion of said swage plug has a groove formed therein around its surface, said groove accommodating an elastomeric O-ring to thereby form a secondary seal with the inside of said filler stem.

14. A centrifuge tube in accordance with claim 1 wherein the bottom portion of said swage plug has at least one protrusion formed around its surface to thereby form a secondary seal with the inside of said filler stem.

15. A centrifuge tube in accordance with claim 14 wherein said at least one protrusion comprises two or more protrusions.

* * * * *